United States Patent [19]

Gordon

[11] 3,998,170

[45] Dec. 21, 1976

[54] ADJUSTABLE WIRE SHELF FOR FROZEN FOODS, AND THE LIKE

[76] Inventor: Harvey Gordon, 32 Paerdegat 12th St., Brooklyn, N.Y. 11236

[22] Filed: Nov. 24, 1975

[21] Appl. No.: 634,853

[52] U.S. Cl. ..... 108/91; 108/137; 206/511; 206/513; 211/153; 211/181; 248/172

[51] Int. Cl.[2] ..... A47B 7/00

[58] Field of Search ..... 108/65, 91, 102, 137; 206/511, 513; 211/153, 178 R, 181; 248/172

[56] References Cited

UNITED STATES PATENTS

| | | | |
|---|---|---|---|
| 1,491,801 | 4/1924 | Holbrook | 248/172 X |
| 2,772,063 | 11/1956 | Rehistein | 248/172 X |
| 3,314,549 | 4/1967 | Goldreich et al. | 206/511 X |

*Primary Examiner*—James C. Mitchell
*Attorney, Agent, or Firm*—Richard L. Miller

[57] ABSTRACT

Two halves, each identical, are formed with vertical leg portions terminating in horizontal loops. The tops of the vertical leg portions of each half are connected by a top horizontal portion which forms a pair of humps which are receivable into the loops of another identical shelf to thereby arrange the shelves in stacked relation. The two halves of the shelf are connected together by a plurality of legs terminating in vertical loops, which vertical loops of one half surround the legs of the other half to thereby vary the length of the shelf.

4 Claims, 2 Drawing Figures

FIG. 1

ADJUSTABLE WIRE SHELF FOR FROZEN FOODS, AND THE LIKE

BACKGROUND OF THE INVENTION

The present invention is directed to a shelf and the stacking of a plurality of shelves. While there are many known shelf arrangements and shelf stacking arrangements, none of the prior art has shown the ease and strength of stacking as presently disclosed.

SUMMARY OF THE INVENTION

It is, therefore, a primary object of the present invention to provide a shelf that may be easily adjusted along its length thereof, and which may be stacked on top of identical shelves to form a stacked arrangement. The shelf of the present invention is of especially useful value, for example, in freezers of refrigerators where shelf space is usually non-existent, and where the compartmentalizing of the freezer would be of great advantage. By using a plurality of shelves of the present invention, separate compartments may be formed in the freezer for the separate storage of any class of frozen goods. Further, since the shelf of the present invention is adjustable in length, it will fit any sized freezer and accommodate itself thereto.

BRIEF DESCRIPTION OF THE DRAWING

The invention will be more readily understood with reference to the following detailed description when taken in conjunction with the accompanying drawings, wherein.

DETAILED DESCRIPTION OF THE INVENTION

Figure 1:
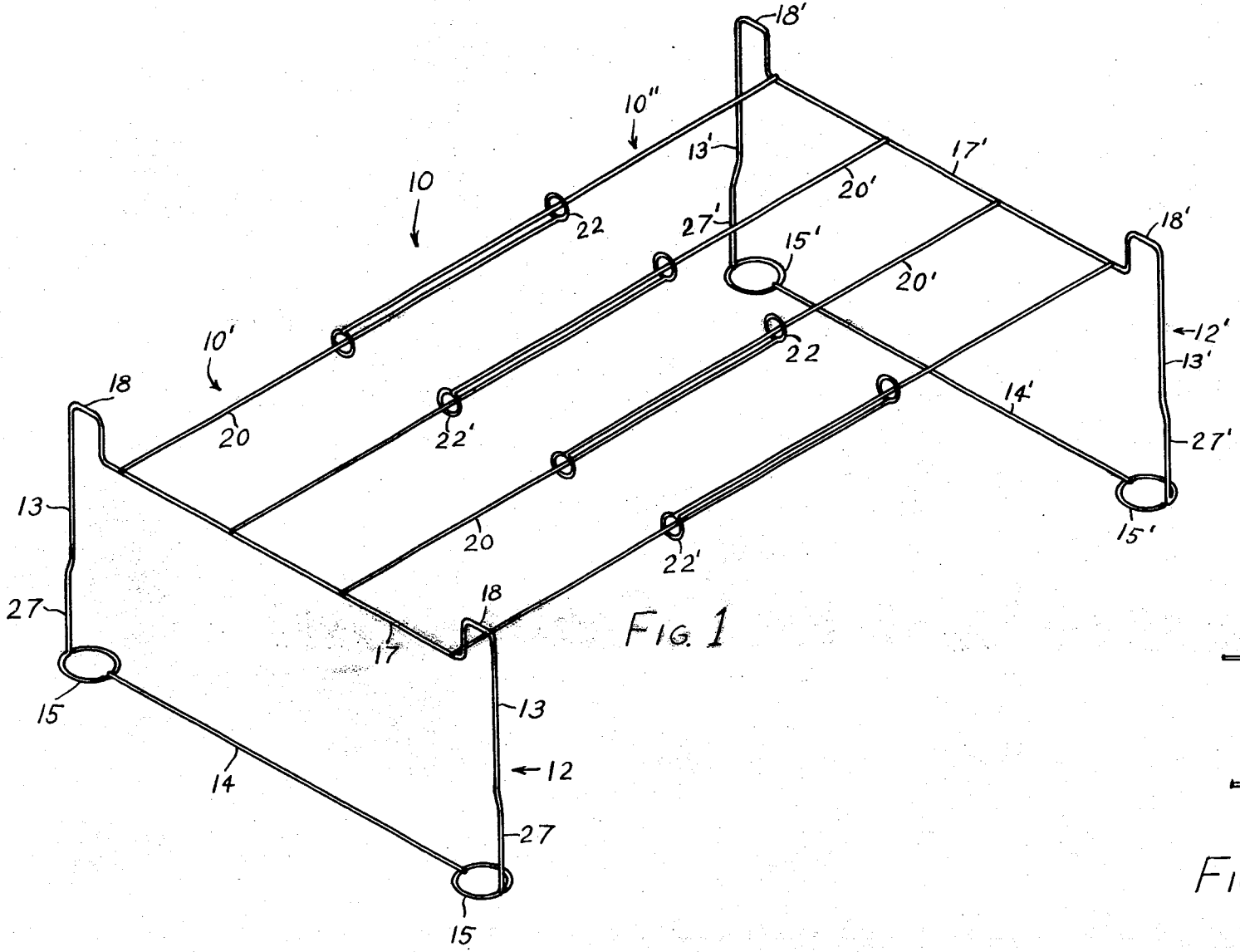
FIG. 1 is a perspective view showing the adjustable wire shelf of the present invention.

Referring now to the FIG. 1, there is shown _ adjustable wire shelf of the present invention which is generally indicated by reference character 10. The adjustable wire shelf 10 is made up of two identical halves 10' and 10''. Each half 10', 10'' has vertical leg portions 12, 12', respectively with vertical portions 13, 13' connected at their bottom ends by a horizontal portion 14, 14'. The horizontal portions 14, 14' connect with wire loops 15, 15' formed on the bottom ends of the vertical portions 13, 13'. These loops 15, 15' are formed integrally with the vertical portions and may be shaped by bending the bottom ends of the vertical portions into loop form, as shown in FIG. 1. In order to accommodate the loops 15, 15', each vertical leg portion has a bent portion 27, 27' which allows for the connection with the horizontal portions 14, 14'.

The top ends of the vertical portions 13, 13' are connected by a top horizontal portion 17, 17' which is shaped to form humps 18, 18'. The top horizontal portions 17, 17' and the vertical portions 13, 13' are formed in one piece, as shown in the drawing, or may alternatively be comprised of separate wire elements. Extending perpendicular to each top horizontal portion 17, 17' are a plurality of parallel wire legs 20, 20', respectively. The ends of each wire leg 20, 20', remote from the top horizontal portions, end in a loop, each loop of a leg in one half encircling a corresponding leg of the other half, as shown in FIG. 1. While four of such legs have been shown in FIG. 1 for each half 10', 10'', it is to be understood that more or less than four legs may be used. Thus, due to overlapping relation between corresponding wire legs in each half 10', 10'', the shelf 10 may be adjustable longitudinally simply by pushing or pulling on the two halves 10', 10'', the loops 22, 22' limiting the amount of movement of the two halves by either contacting each other or the top horizontal portions 17, 17'.

Figure 2:
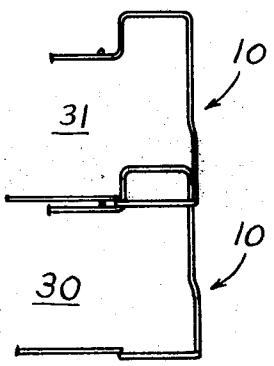
FIG. 2 is a side elevational view showing two of the adjustable wire shelves in stacked arrangement.

The humps 18, 18' and the loops 15,15' allow for the stacking of two or more shelves. As shown in FIG. 2, the humps 18,18' of one shelf are received in the loops 15,15' of another shelf positioned above it. By such stacking, shelf space, such as 30, 31 in FIG. 2, is realized which receive frozen packages, cans, and the like. In stacked relation, the stacks 10 may be expanded or shortened merely by pulling or pushing on the ends of only one shelf 10, since the other shelves will also be expanded or shortened in response to force on only one.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An adjustable wire shelf comprising a first half and a second half, each of said first and second halves comprising two parallely spaced vertical leg portions, each leg portion having a first end formed into a horizontal loop and a second end spaced from said first end, a bottom horizontal portion connecting the horizontal loops of said vertical leg portions, a top horizontal portion having a first hump near said second end of one of said vertical leg portions and a second hump spaced from said first hump near said second end of the other of said vertical leg portions, and a plurality of parallely spaced horizontal legs extending perpendicularly from said top horizontal portion, each horizontal leg having a first end connected to said top horizontal portion and a second end spaced from said first end of said leg in a direction perpendicular to the plane containing said vertical leg portions, said second end of said leg having a loop formed thereon extending in a vertical direction, said vertical loops of one of said halves completely surrounding a corresponding one of said horizontal legs of the other of said halves, said shelf defining a shelf space for the reception of frozen goods and the like, each of said vertical leg portions comprising a bent portion, said bent portion being formed in order to allow for the formation of said horizontal loop, whereby the two halves are adjustably positionable relative to each other and together form a shelf that may be shortened or lengthened.

2. The adjustable wire shelf according to claim 1, wherein each of said halves comprises four of said horizontal legs.

3. The adjustable wire shelf according to claim 1, wherein said vertical leg portions of each half are formed integrally with said top horizontal portion of the respective half.

4. The adjustable wire shelf according to claim 1, comprising two of said adjustable wire shelves, said horizontal loops of one of said shelves fitting over and received by said humps of the other of said shelves to thereby arrange the shelves in stacked arrangement.

* * * * *